US005224889A

United States Patent [19]

Hickey

[11] Patent Number: 5,224,889

[45] Date of Patent: Jul. 6, 1993

[54] PROPELLER GUARD

[76] Inventor: Arthur S. Hickey, 6421 Blossom Park Dr., Dayton, Ohio 45449

[21] Appl. No.: 801,379

[22] Filed: Dec. 2, 1991

[51] Int. Cl.[5] ..... B63H 5/16

[52] U.S. Cl. ..... 440/71; 440/72

[58] Field of Search ..... 440/66, 71, 72, 67, 440/51, 113, 89, 78, 75, 53, 69, 87

[56] References Cited

U.S. PATENT DOCUMENTS 2,717,570 9/1955 Willoughby ..... 440/71
3,965,845 6/1976 Lubov ..... 440/71
4,096,819 6/1978 Evinrude ..... 440/71
4,304,558 12/1981 Holtermann ..... 440/89
5,007,869 4/1991 Zoellner ..... 440/71
5,017,165 5/1991 Havins ..... 440/71

*Primary Examiner*—Joseph F. Peters, Jr.
*Assistant Examiner*—Kenneth Lee
*Attorney, Agent, or Firm*—Donald P. Gillette

[57] ABSTRACT

A device to protect the propellor of a boat from damage caused by striking underwater obstacles, when the boat is moving in any direction relative to the obstacles, and to improve the movement of the boat along the water.

17 Claims, 1 Drawing Sheet

PROPELLER GUARD

BACKGROUND OF THE INVENTION

1. Field of the Invention

This invention relates to the field of guards for boat propellers. In particular, it relates to a guard that protects a boat propeller from collision with the bottom or with objects in the path of the propeller and that also enhances the smoothness of ride of the boat.

2. The Prior Art

Power boats, especially those driven by outboard motors or inboard-outboard drives, are frequently used in relatively shallow water or in places having underwater obstructions that can collide with the propeller or propellers. This can happen not only when the boat is moving forward but also when it is in reverse or is sluing sideways in a turn, and when such a collision occurs, it frequently causes considerable damage to the propeller. Moreover, the object struck is not always an inanimate object; it is sometimes a living creature, such as a manatee or even a human being, and the damage from the impact may be even more devastating to the object struck than to the propeller.

Even if the object is inanimate and even if the propeller can be repaired, such a collision can render the propeller instantaneously inoperative, requiring the person or people in the boat to find some way of returning to the dock without power. Once the boat has been brought back, the cost of replacing or repairing the propeller is relatively high. In addition, the damage may not be limited to the propeller; it is not uncommon for other parts of the drive mechanism, even including the motor itself, to be damaged and to need repair or replacement.

In the course of experimenting with the propeller guard to be described herein, I discovered that the smoothness of operation of the boat is also improved. It rides higher in the water, even at relatively low speeds, and is less affected by chop.

OBJECTS AND SUMMARY OF THE INVENTION

It is an object of this invention to provide means to guard a boat propeller from impact with an obstruction in its path, whether the boat is moving forward or backward or is sluing sideways.

A further object is to provide a propeller guard that will prevent such impact upon the propeller from the front, rear, and sides.

Another object is to provide a propeller guard that is easy to install and that not only protects the propeller against damage from collision with other objects but also reduces the damage to the object struck.

Still another object is to provide a propeller guard that improves the operation of the boat on which the guarded propeller is used.

After studying the following description, those skilled in the art will become aware of still further advantages to be obtained from this invention.

In accordance with this invention, a guard plate is mounted on a marine drive unit so as to be parallel to the anti-cavitation plate and a short distance below the lowest part of the circle traced out by the tips of the propeller blades. It is common for marine drive units to have a vertical skeg that extends down just ahead of the propeller, and it is convenient to mount the guard plate on the skeg so as to be approximately at the level of the lowest part of the skeg.

However, if the marine drive unit does not have a skeg, the propeller guard of this invention can be mounted on the part of the lower unit surrounding the propeller shaft. The guard plate is mounted so that its forward end is forward of the propeller, and the guard plate is long enough so that it extends under the propeller, with the trailing edge of the guard plate farther aft than the aftermost part of the propeller. At a location directly under the propeller, the guard plate is at least substantially as wide as the tip circle. Preferably, its width is at a minimum at the skeg and increases from the region of minimum width at the front to a region of maximum width at the rear edge. It is also preferable for the rear edge to be tilted downward.

The guard plate may be attached to the skeg as an after-market device, or it can be molded, or otherwise formed, as part of the skeg or lower unit. If the guard plate is to be attached to an existing marine drive unit, the forward part of the plate is typically bent upward, preferably to conform to the angle of the forward edge of the skeg, and is mounted against that edge. The part of the plate that extends aft and is parallel to the anti-cavitation plate is preferably mounted up against the lowermost edge of the skeg, which may be a horizontal edge or may simply be a place where the forward and aft edges of the skeg come together. Attachment means for attaching the guard plate to the skeg constitute plate means rigidly joined to the upper surface of at least the forward part of the plate and comprising two sides equally spaced from the center line of the guard plate and arranged to receive the lower part of the skeg. When the skeg is forced between the two sides, the guard plate may be made secure by bolts that pass through the skeg and both sides of the attachment means.

The invention will be described in greater detail in connection with the drawings, in which like serial numbers in different figures indicate the same item.

DETAILED DESCRIPTION OF A PREFERRED EMBODIMENT

Figure 1:
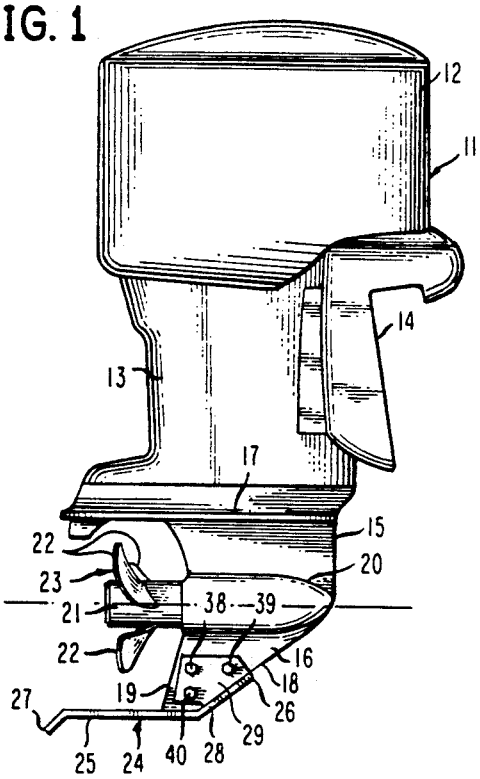
FIG. 1 is a side view of a marine drive, showing the propeller and one embodiment of a propeller guard according to this invention.

FIG. 1 shows a typical marine drive 11 for a boat. In this embodiment, the drive is an outboard motor, the power unit of which is located in a housing 12. A drive shaft housing 13 extends downwardly from it and is provided with clamping means 14 to attach the drive 11 to the transom, or a similar structure, of a boat (not shown). The drive shaft housing is usually mounted at the center of the transom on the longitudinal center of the boat, although it is not uncommon for a boat to be provided with two drive units mounted symmetrically on opposite sides of the longitudinal central plane of the boat.

The drive shaft housing 13 terminates in a lower unit 15 that includes a skeg 16, which is essentially a vertical, streamlined strut, that constitutes the lowest part of the lower unit. Between the upper part of the shaft housing 13 and the lower unit 15 is an anti-cavitation plate (sometimes simply called a cavitation plate) 17 that is perpendicular to the drive shaft in the housing 13. The front edge 18 of the skeg typically slopes back at a smaller angle to the horizontal than does the rear edge 19, causing the skeg 16 to be narrower from front to rear along its bottom edge than at points higher on the skeg. A torpedo-shaped enlargement of the skeg is provided as a gear case 20 for gears that connect a vertical drive shaft within the shaft housing to an internal, horizontal shaft (not visible in the drawings) on which a propeller hub 21 is mounted.

Some hubs, such as the one shown, are open at the rear end and are connected to the internal shaft by a separable rubber coupler (not shown) that is supposed to be disrupted if the propeller blades 22 are snagged by an underwater obstruction. The hub 21 and the blades constitute a propeller 23. The purpose of having a propeller connected to its drive shaft by a rubber coupler is to prevent the blades from being damaged by being thrashed against an underwater obstruction, but it has been found that these couplers do not always perform as desired and that the blades are frequently bent or broken as a result of the impact with the obstruction. In fact, it is not uncommon for parts internal to the lower unit 15, and even the drive shaft or the motor in the housing 12, to be damaged by particularly severe impacts.

Figure 2:
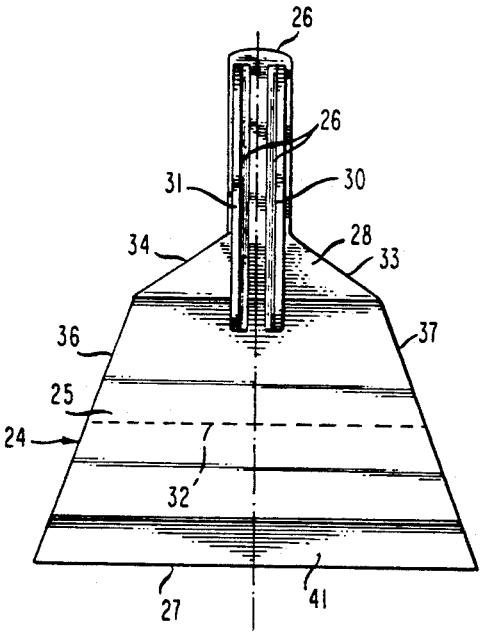
FIG. 2 is a top view of the propeller guard in FIG. 1.
Figure 3:
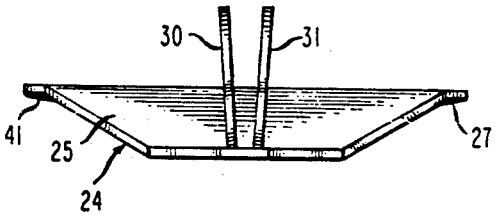
FIG. 3 is a view of the propeller guard in FIG. 2 looking directly at the front end thereof.

According to the present invention, a propeller guard structure 24, such as that shown in FIGS. 1–3, is provided to shield the propeller blades from striking obstructions. The structure 24 includes a guard plate 25 mounted so that it is below a circular path traced out by the tips of the propeller and is in a plane parallel to the anti-cavitation plate and perpendicular to the vertical central plane of the skeg 16. The longitudinal dimension of the guard plate is great enough so that its front end 26 is forward of the propeller 23 and its rear end 27 is aft of the propeller. The front part 28 of the guard plate is bent or curved up and is provided with attachment means 29 located on the center line of the guard plate 25. In this embodiment, the attachment means include two plates 30 and 31 spaced just far enough apart to receive at least enough of the lower part of the skeg 16 below the gear case 20 to allow the guard structure to be rigidly attached to the skeg. The two plates 30 and 31 are rigidly joined to the guard structure 24, for example, by being welded to it, to extend upward so that the plates are substantially perpendicular to the front part 28. Preferably, the plates are not precisely parallel to each other but are slightly tilted so that they are slightly closer together immediately adjacent the front part 28 than they are at points more distant from the front part. This is best seen in FIGS. 2 and 3. In FIG. 3, the view is directly parallel to the front part 28. When the plates 30 and 31 are slightly splayed out, they conform most closely to the slightly tapered configuration of the skeg. It should also be understood that the two plates 30 and 31 could be joined together adjacent the front end 26 to form a U-shaped bracket, preferably formed to fit the front edge 18 of the skeg 16.

The width of the guard plate 25 in this embodiment is not necessarily uniform from front to rear. In fact, as shown in FIGS. 2 and 3, the width of the guard plate increases linearly from front to rear. At a longitudinal location directly beneath the tip circle of the propeller, represented by the broken line 32, the guard plate is at least substantially as wide as the diameter of the tip circle of the blades 22. In the embodiment illustrated in FIG. 2, the plate 25 tapers outwardly, thus presenting a generally trapezoidal form symmetrical about its longitudinal center line.

The front part 28 is also trapezoidal, and in this embodiment, its sides 33 and 34 taper outwardly more sharply than do the edges 36 and 37 of the main part of the plate 25. As a result, the front end 26 extends out beyond the forwardmost parts of the edges 33 and 34.

The propeller guard structure 24 is attached to the skeg 16 by means of bolts 38–40. In order to install the structure 24 on a marine drive unit, holes are drilled through the skeg in the proper locations to receive the bolts. The plates 30 and 31 can be used as templates to put the holes in the proper locations. In determining the proper location, the structure 24 may be partially installed and then the distance from the anti-cavitation plate 17 to the guard plate 25 measured to be sure that the plate 25 is parallel to the anti-cavitation plate when the remaining bolt holes are formed and the guard structure 24 is rigidly bolted in place.

When the propeller guard 24 is mounted as shown in FIG. 1, it is very effective in preventing damage to the propeller. It prevents contact between the blades 22 and the bottom of a shallow waterway or an obstacle, such as a stump, sticking up from a deeper bottom. This protection is not only provided when the boat is moving forward but also when it is sluing around in a tight turn. In addition, when the drive unit is put in reverse to back the boat into a mooring or into the bank of a waterway, the fact that the rear edge 27 extends out to the rear of the propeller protects the blades 22 from being rammed into any part of an embankment or dock or any other obstruction.

Although the front part 28 would appear to exert drag when the structure 24 is used on a boat, I have found that there appears to be little or no measurable adverse effect. The front part makes an angle that may be anywhere from about 10° and 35° from the horizontal plane, which means that the angle of the bend is approximately 135° to 170°. In fact, all of the boats on which I have tested this propeller guard operate at least substantially as efficiently with it as without it, and frequently operate better. They rise up on a plane more readily and at lower speeds, and they ride more smoothly on choppy water. This applies not only to single-hulled boats, but also to pontoon boats. Having the boats ride higher may reduce their normal drag by more than the amount added by the front part 28. It is also possible that the fact that the flat plate 25 extends parallel to the anti-cavitation plate and farther aft than the propeller and about an inch below the lowest point on the tip circle provides a semi-closed channel for water affected by the action of the propeller.

Although I am not certain of the hydrodynamic reasons for operation of the propeller guard in improving operation of the boat, it may be that the flat plate 25 prevents water from being forced down and allows it to escape primarily to the rear, thus increasing the effective thrust.

I have also found it to be advantageous to bend or form the rear part 41 of the plate 25 so that it is tilted down. The angle of that bend is such that the rear part is tilted down at an angle of about 17° to the horizontal plane defined by the plate 25. Thus, the angle between the part 41 and the plate is optimally about 163°, although, it may be anywhere between about 170° and 135°.

In addition, the area of the rear part 41 in comparison to the area of the main part of the plate 25 may also vary. Preferably the longitudinal dimension of the rear part 41 in the direction parallel to the center line of the plate 25 should be about 10% of the total length of the main part, but it may be as much as about 33%.

Figure 4:
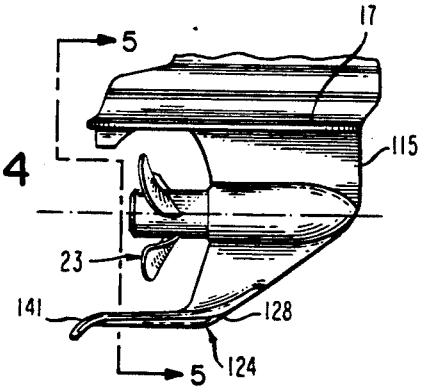
FIG. 4 is a side view of part of a marine drive with a propeller guard formed integrally with the lower unit.
Figure 5:
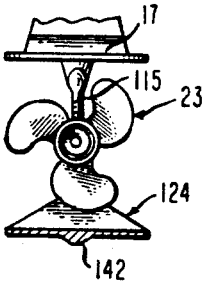
FIG. 5 is a rear view, partly in cross section, of the embodiment in FIG. 4, partly in cross section along the line 5—5.

FIGS. 4 and 5 show several modifications in the propeller guard. In the embodiment shown in these figures, the guard structure 124 is cast or molded as part of the lower unit 115 instead of being attached later. This makes it possible to achieve better streamlining of the structure as well as eliminating all problems of assembly. The structure 124 includes a flat plate 125, the front part 128 of which is curved up and the rear part 141 of which is curved down. The structure 124 and the part of the lower unit 115 formed with it can be formed of metal, such as aluminum, or of a plastic having sufficient strength and rigidity. If it is formed of a plastic, the plastic can be additionally strengthened by internal fibers of graphite, glass, or other known strengthening materials.

FIG. 5 shows the cross-sectional shape of the plate 125, including a ridge 142 on its underside. This ridge strengthens the plate 125 and prevents it from being bent up, either by striking an obstruction or by differential pressure of the water above and below the plate. While the ridge 142 is formed at the same time the rest of the structure 124 is formed, it could also be added later, and a similar ridge could be added to the plate 25 in FIGS. 1–3, for example, by being welded to it.

The invention has been described in terms of specific embodiments, but it will be apparent to those skilled in the art that modifications may be made therein without departing from the true scope of the invention.

What is claimed is:

1. In an outboard marine drive structure for a boat that has a longitudinal dimension, the outboard drive structure comprising an anti-cavitation plate and a lower unit located below the anti-cavitation plate and comprising a gear housing with a skeg extending downwardly therefrom and a propeller drive shaft extending from the rear of the gear housing and supporting a propeller to rotate about an axis parallel to and spaced a predetermined distance below the anti-cavitation plate, the propeller having a plurality of blades with tips extending a predetermined radial distance from the axis to define a tip circle when the propeller rotates:

(a) protection means comprising a guard plate having a front end, a rear portion spaced longitudinally from the front end, and a substantially flat central portion extending longitudinally between the front end and the rear edge; and (b) means rigidly supporting the guard plate with the central portion thereof parallel to the anti-cavitation plate and at a level sufficiently below the axis to extend beneath the tip circle of the propeller and with the front end of the guard plate located farther forward than any part of the propeller and the rear edge located farther aft than any part of the propeller, the width of the guard plate, at a location directly beneath the tip circle of the propeller, being at least substantially equal to the diameter of the tip circle.

2. The protection means of claim 1 in which the central part of the guard plate is spaced below the axis of the propeller by a distance approximately equal to the predetermined distance from the anti-cavitation plate to the axis.

3. The protection means of claim 1 in which the front part of the guard plate tilts up relative to the central part of the guard plate.

4. The protection means of claim 3 in which the front end tilts up at an angle between 170° and 135° relative to the central part.

5. The protection means of claim 4 in which the front end is substantially flat and intersects the central part at a bend region extending across the guard plate.

6. The protection means of claim 5 in which:

(a) the guard plate has a front end;

(b) the attachment means extends along the front part to the front end; and (c) the width of the front part tapers to a width substantially equal to the width of the attachment means at an intermediate position along the attachment means.

7. The protection means of claim 1 in which the rear portion is bent downwardly at an angle between about 145° and 170° relative to the central portion.

8. The protection means of claim 7 in which the rear portion has a longitudinal dimension not substantially greater than one-third of the total longitudinal dimension of the guard plate.

9. The protection means of claim 8 in which the rear portion has a longitudinal dimension not substantially greater than one-tenth of the total longitudinal dimension of the guard plate.

10. The protection means of claim 1 comprising, in addition:

(a) a front portion tilted up at an angle to the guard plate; and (b) receiving means rigidly joined to the forward portion and extending substantially perpendicularly therefrom and comprising first and second sides spaced apart by a distance sufficient to receive at least the lower part of the skeg; and (c) attachment means rigidly joining the receiving means to the skeg.

11. The guard structure of claim 1 in which the skeg has a front edge that slopes at a first angle relative to the plane of the cavitation plate, a rear edge that slopes at a steeper angle to the cavitation plate, and a lowermost edge joining the front and rear edges, the guard structure comprising a front portion that extends upwardly from the front edge of the guard plate at an angle not substantially greater than said first angle, the receiving means being affixed to the front portion of the guard structure with the front portion in contact with the front edge of the skeg.

12. The guard structure of claim 11 in which the receiving means is affixed to the skeg with the guard plate in contact with the front edge of the skeg.

13. An outboard marine drive structure for a boat that has a longitudinal dimension, the outboard drive structure comprising:

(a) an anti-cavitation plate;

(b) a lower unit located below the anti-cavitation plate and comprising:

(i) a gear housing, (ii) a skeg extending downwardly from the gear housing, and (iii) a propeller drive shaft extending from the rear of the gear housing and supporting a propeller to rotate about an axis parallel to and spaced a predetermined distance below the anti-cavitation plate, the propeller having a plurality of blades with tips extending a predetermined radial distance from the axis to define a tip circle when the propeller rotates:

(c) protection means integrally formed with the skeg and comprising a guard plate having a front end, a rear portion spaced longitudinally from the front end, and a substantially flat central portion parallel to the cavitation plate and extending longitudinally between the front end and the rear portion; and (d) means rigidly supporting the guard plate parallel to the anti-cavitation plate and at a level sufficiently below the axis to extend beneath the tip circle of the propeller and with the front end of the guard plate located farther forward than any part of the propeller and the rear edge located farther aft than any part of the propeller, the width of the guard plate, at a location directly beneath the tip circle of the propeller, being at least substantially equal to the diameter of the tip circle.

14. The outboard drive structure of claim 1 in which the guard structure has a bottom surface with a longitudinal rib extending along the bottom surface.

15. The outboard drive structure of claim 14 in which the guard structure is substantially symmetrical about a central plane and the longitudinal rib extends along the central plane.

16. The outboard drive structure of claim 14 in which the guard structure is cast as part of the lower unit.

17. The outboard drive structure of claim 14 in which the guard structure is molded as part of the lower unit.

* * * * *